United States Patent [19]

Glass et al.

[11] Patent Number: 4,730,595

[45] Date of Patent: Mar. 15, 1988

[54] DISC LAUNCHER

[76] Inventors: Herbert G. Glass, 4402 S. Park Ave., Dothan, Ala. 36301; Henry G. Glass, P.O. Box 7553, Roanoke, Va. 24019

[21] Appl. No.: 907,255

[22] Filed: Sep. 15, 1986

[51] Int. Cl.[4] ..... F41B 5/00

[52] U.S. Cl. ..... 124/5; 124/42

[58] Field of Search ..... 124/5, 42, 43, 81, 79; 403/104, 107, 92, 97

[56] References Cited

U.S. PATENT DOCUMENTS

| | | | |
|---|---|---|---|
| 1,700,880 | 2/1929 | Camp | 124/5 |
| 2,228,592 | 1/1941 | Curtis | 403/104 |
| 3,537,438 | 11/1970 | Reed | 124/43 |
| 3,593,949 | 7/1971 | Fliege | 403/104 |
| 4,076,004 | 2/1978 | Huelskamp . | |
| 4,170,215 | 10/1979 | Kettlestrings | 124/16 |
| 4,222,361 | 9/1980 | Jackson et al. | 124/5 |
| 4,233,952 | 11/1980 | Perkins | 124/5 |

*Primary Examiner*—Randolph A. Reese
*Assistant Examiner*—Peter M. Cuomo
*Attorney, Agent, or Firm*—Sughrue, Mion, Zinn, Macpeak, and Seas

[57] ABSTRACT

A hand held disc launcher is constructed of one piece molded plastic material having a handle and a flat head portion having a symmetrical construction on opposite sides thereof whereby the launcher may be used by a left handed or right handed person. Projections extend on opposite sides of the head portion on one side of the axis of the handle and a flexible arm extends from the head portion on the opposite side of the axis of the handle whereby a disc may be held on the head portion between the projection and the arm. A projection is formed on the free end of the arm and a complementary recess is formed in the rim of the disc so that a spinning motion is imparted to the disc as it leaves the launcher under the influence of centrifugal force which overcomes the holding force of the flexible resilient arm.

5 Claims, 7 Drawing Figures

DISC LAUNCHER

BACKGROUND OF THE INVENTION

The present invention is directed to a disc launcher and more specifically to a hand held disc launcher having resilient means thereon cooperating with the disc to hold the disc in place and to impart a spinning motion to the disc upon release from the launcher.

The use of hand held launchers having a target trap thereon for launching clay pigeon targets is old and well known in the trap shooting art. Such devices are generally complicated in construction and are comprised of a relatively large number of parts which are interconnected together with suitable springs or resilient members in order to hold the disc in position during the initial throwing action and to impart a spinning action to the disc as it is released from the launcher.

A typical prior art construction is shown in the U.S. Pat. No. 1,700,880, to Camp, wherein a handle 1 has a resilient portion mounted thereon having a curved extension for receiving a stepped target disc. An arm is pivotally mounted on the resilient portion in opposition to the extension and is spring biased towards the extension in order to hold the disc between the pivoted arm and the extension. A rubber member is mounted at the outermost end of the pivoted arm and is maintained in engagement with the disc so that upon imparting a whipping motion to the launching device the spring biased pivoted arm will be forced away from the extension due to the centrifugal force acting on the disc thereby allowing the disc to leave the launcher. As the disc leaves the launcher it will be frictionally engaged with a rubber collar whereby a spinning action will be imparted to the disc.

A similar hand operated target projecting device is also disclosed in U.S. Pat. No. 3,537,438, to Reed. However in Reed a curved resilient arm is mounted in opposition to the extension of the handle member in order to hold the target disc therebetween. The outermost end of the resilient arm is provided with a spring clip 13 which frictionally engages the top and bottom surfaces of the disc so that upon launching the disc a spinning movement will be imparted to the disc.

Other types of disc launchers rely primarily upon the inherent resilient force of a flexible impeller having one end fixedly mounted on the hand held launching device with the other end engaged with the disc so that upon release of a latch the resilient impeller launches the disc into space with a spinning action. An example of such a launcher is disclosed in U.S. Pat. No. 4,170,215, to Kettlestrings..

SUMMARY OF THE INVENTION

The present invention provides a new and improved hand held disc launcher of one piece molded plastic construction which is inexpensive to manufacture, easy to operate and extremely reliable and accurate in operation.

The present invention provides a new and improved disc launcher comprised of a head portion and a handle portion disposed in a common plane wherein the launcher is substantially symmetrical in construction on opposite sides of said plane whereby the disc to be launched may be mounted on either surface of the head portion so that the launcher may be held and operated by either the left hand or the right hand.

The present invention provides a new and improved disc launcher comprised of a handle, a relatively flat open light weight head extending outwardly from one end of the handle, disc engaging means disposed along one edge of said head on one side of the axis of the handle and projecting perpendicular to the plane of said head an equal distance on opposite sides of said plane, a curved resilient arm extending outwardly from said head on the opposite side of said axis with portions of the arm projecting on opposite sides of said plane of said head for gripping a disc between said resilient arm and said projection means on either side of said head and engaging means on the free end of said arm adapted to cooperate with complementary engaging means on a disc for engaging said disc and imparting a spinning action to said disc as the disc leaves the launcher under the action of centrifugal force. Additional means may be provided for adjusting the flexibility and resiliency of the arm.

The present invention provides a new and improved disc and disc launcher combination comprising a disc launcher having a handle, a flat light weight head extending from one end of said handle, projecting means disposed at one edge of said disc on one side of the axis of said handle and projecting an equal distance on opposite sides of the plane of said head, resilient arm means extending from the opposite side of said head on the opposite side of said axis for holding a disc between said resilient arm means and said projection means on either side of said disc, disc engaging means disposed on the free end of said resilient arm and a disc having engaging means complementary to said engaging means on said resilient arm for imparting a spinning action to said disc as it leaves the launcher under the action of centrifugal force. Adjustable connection means may be provided for adjusting the resiliency of the arm.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
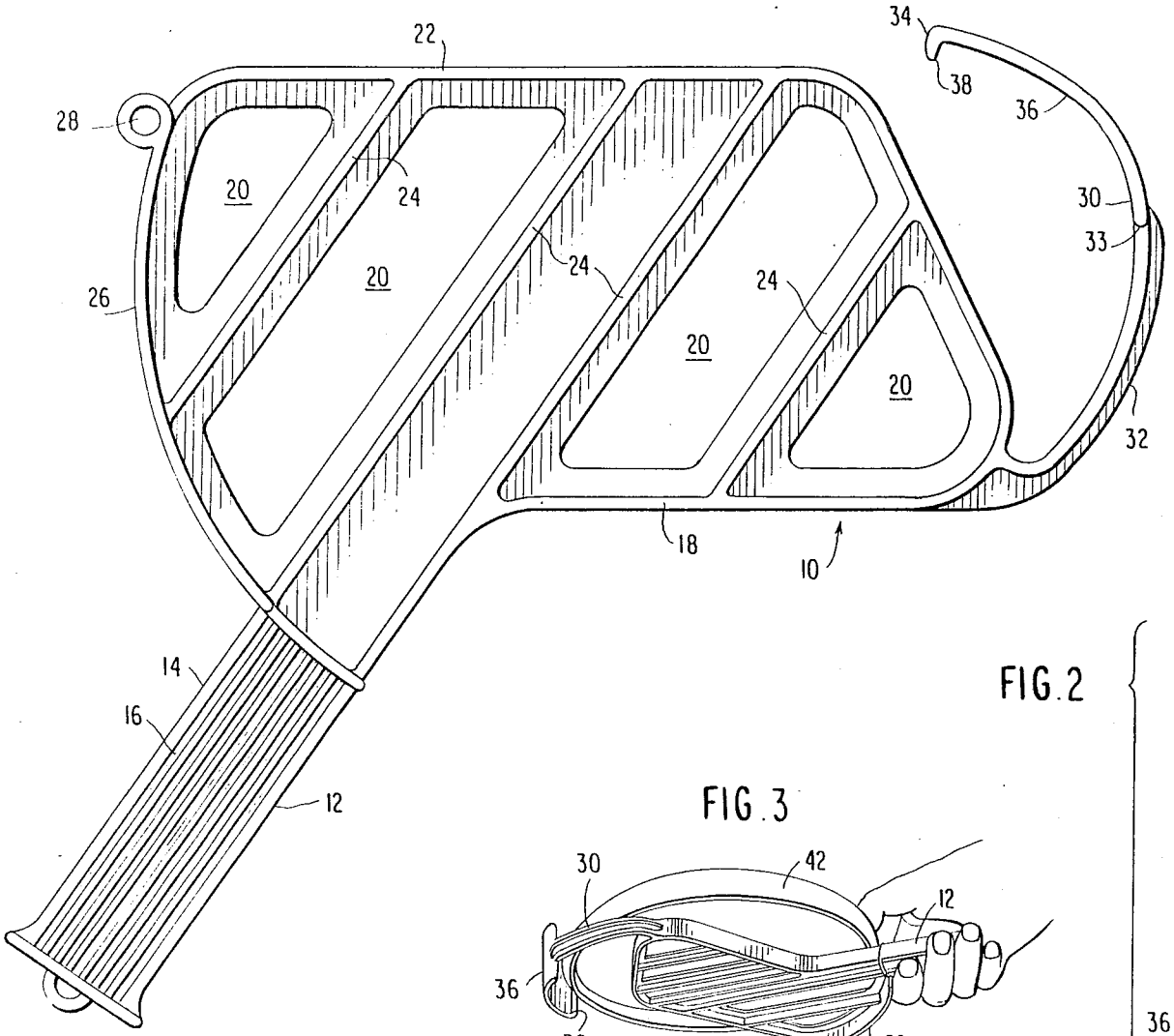
FIG. 1 is a plan view of a hand held disc launcher according to a first embodiment of the present invention.
Figure 2:
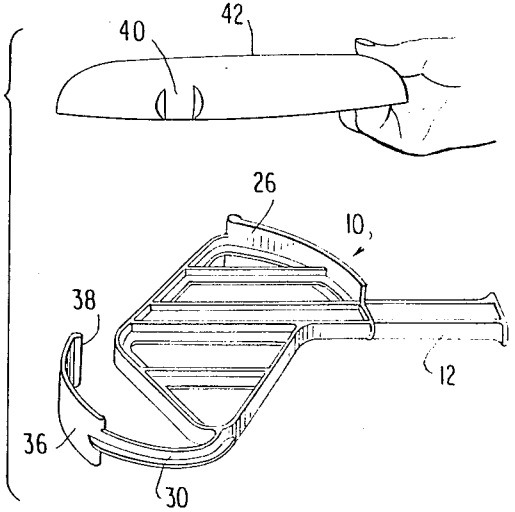
FIG. 2 is a perspective view of the disc launcher shown in FIG. 1 and disc prior to insertion of the disc into the launcher.
Figure 3:
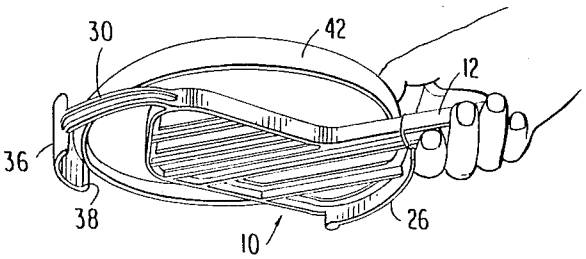
FIG. 3 is a perspective view of the disc launcher shown in FIGS. 1 and 2 with the disc mounted therein for a right handed launching operation.

The disc launcher 10 shown in the embodiment of FIGS. 1–3, inclusive, has a one piece molded plastic construction. The disc launcher includes a handle 12 having a plurality of alternating ribs 14 and grooves 16 to provide a good grip and a relatively flat head portion 18 extending outwardly from the handle 12. The flat head portion 18 is provided with a plurality of apertures 20 for the reduction of weight, a rib 22 extending about the entire periphery of the head and a plurality of transversely extending ribs 24 which extend substantially parallel to the axis of the handle 12. The rib 22 along one side of the head is substantially wider than the remaining portion of the rim 22 to define a support flange 26 which extends an equal distance on opposite sides of the plane of the head 18. The flange 26 terminates at one end adjacent the handle 12 and a thickened projection 28 is formed at the opposite end of the flange 26. The flange 26 has a curvature substantially equal to the curvature of the rim of the disc adapted to be used with the launcher for supporting the disc on the launcher. In lieu of the flange 26 a second projection similar to the projection 28 could be formed adjacent the handle so that the two spaced apart projections would form a support for the periphery of the disc.

A flexible resilient arm 30 extends outwardly from the head at a point substantially diametrically opposite the projection 28 assuming the flange 26 is disposed along the arc of the circle. The arm 30 is provided with a reinforcing rib 32 which protrudes outwardly from the arm 30 in the plane of the head 10. The rib 32 extends substantially along half the length of the arm 30 which has a curved configuration. From the point 33 on the arm 30 adjacent the end of the rib 32 to the free end 34 of the arm 30, the arm 30 has a substantially wider dimension as best seen in FIGS. 2 and 3 to provide a support for the periphery of the disc to be held by the launcher. The wide portion 36 of the arm 30 extends an equal distance on opposite sides of the plane of the head 18. A projection in the form of a transverse rib 38 is formed on the free end 34 of the arm 30 which is adapted to mate with a complementary groove 40 formed in the periphery of the disc 42 as best seen in FIG. 2. The complementary engaging means on the flexible arm 30 and the disc 42 may be of any suitable configuration such as a pin on the arm and a hole in the disc or even roughened surfaces which will provide a frictional engagement between the arm and the disc.

The operation of the launcher 10 can be readily understood from the illustration of the disc with the launcher in FIGS. 2 and 3. For a right handed person the launcher 10 would be oriented in the manner shown in FIGS. 2 and 3. The disc 42 would be placed on the upper surface of the head 18 with the notch 40 in engagement with the projection 38 on the arm 30. A right handed person would then grasp the handle as shown in FIG. 3 with the thumb placed on the upper surface of the disc 42 adjacent the edge thereof. The launcher will then be moved forward with a substantially horizontal side arm motion to provide a whipping action which will impart centrifugal force to the disc 42 sufficient to overcome the force of the resilient flexible arm 30 when the thrower releases the thumb pressure on the disc. As the disc 42 leaves the launcher it will tend to pivot about the projection 38 due to the engagement between the projection 38 and the groove 40 on the disc to impart a spinning motion to the disc.

Figure 4:
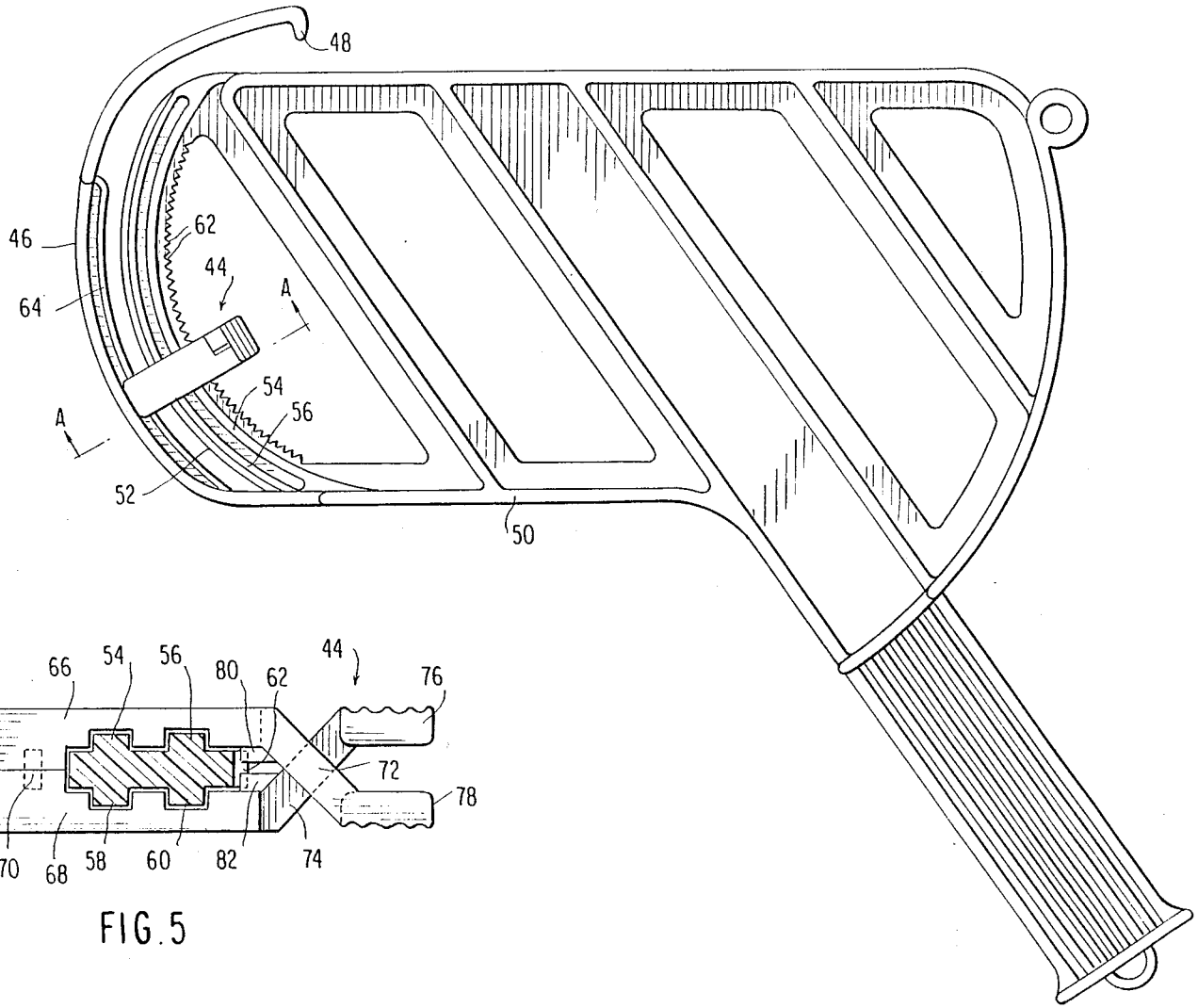
FIG. 4 is a plan view of a second embodiment of the disc launcher according to the present invention incorporating means for adjusting the resiliency of the flexible arm.
Figure 5:
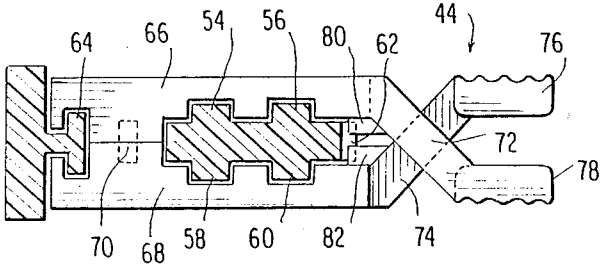
FIG. 5 is a sectional view taken along the line A—A in FIG. 4.

In the embodiment of FIGS. 4 and 5 a clamp 44 is provided for effectively varying the length of the flexible resilient arm 46. In this manner the flexibility as well as the resiliency of the arm 46 is changed so that the shorter the length of the arm the greater the force will be for engaging the projection 48 with the notch in the disc. More specifically, the head 50 is provided with an arcuate end portion 52 having a pair of parallel arcuate ribs 54 and 56 protruding from the upper surface thereof. Identical ribs 58 and 60 are provided on the opposite side of the arcuate end portion 52. A plurality of serrations or teeth 62 are formed along the inner edge portion of the arcuate portion 52. A projection 64 having a T-shaped cross sectional configuration extends along the inner circumference of the curved arm 46 so that the opposite ends of the T-shaped projection 64 extend substantially parallel to the ribs 54–60.

The clamp 44 is comprised of two identical members 66 and 68 which are connected together at 70 by any suitable means. The clamping members 66 and 68 each have a plurality of opposed grooves which are complementary to and adapted to receive the ribs 54–60 and the opposed projections on the T-shaped projection 64. Each clamping member 66 and 68 is provided with oppositely angled end portions 72 and 74, respectively, each of which has a serrated finger grip portion 76 and 78, respectively at the outer ends thereof. The clamping member 66 and 68 are each provided with a pair of opposed tooth members 80 and 82, respectively, which engage with the teeth 62 formed on the head 50.

In order to vary the effective length of the arm 46 it is only necessary to squeeze the finger grip portions 76 and 78 towards each other thereby moving the teeth 80 and 82 away from each other out of engagement with the teeth 62 on the head 50. The clamping member 44 will then be free to slide along the T-shaped projection and ribs to a new position along the length of the arm 46. Upon release of the finger grip portions 76 and 78 the inherent resiliency of the clamping members 66 and 68 will return the teeth 80 and 82 into engagement with the teeth 62 to hold the clamping member 44 in a new position.

Figure 6:
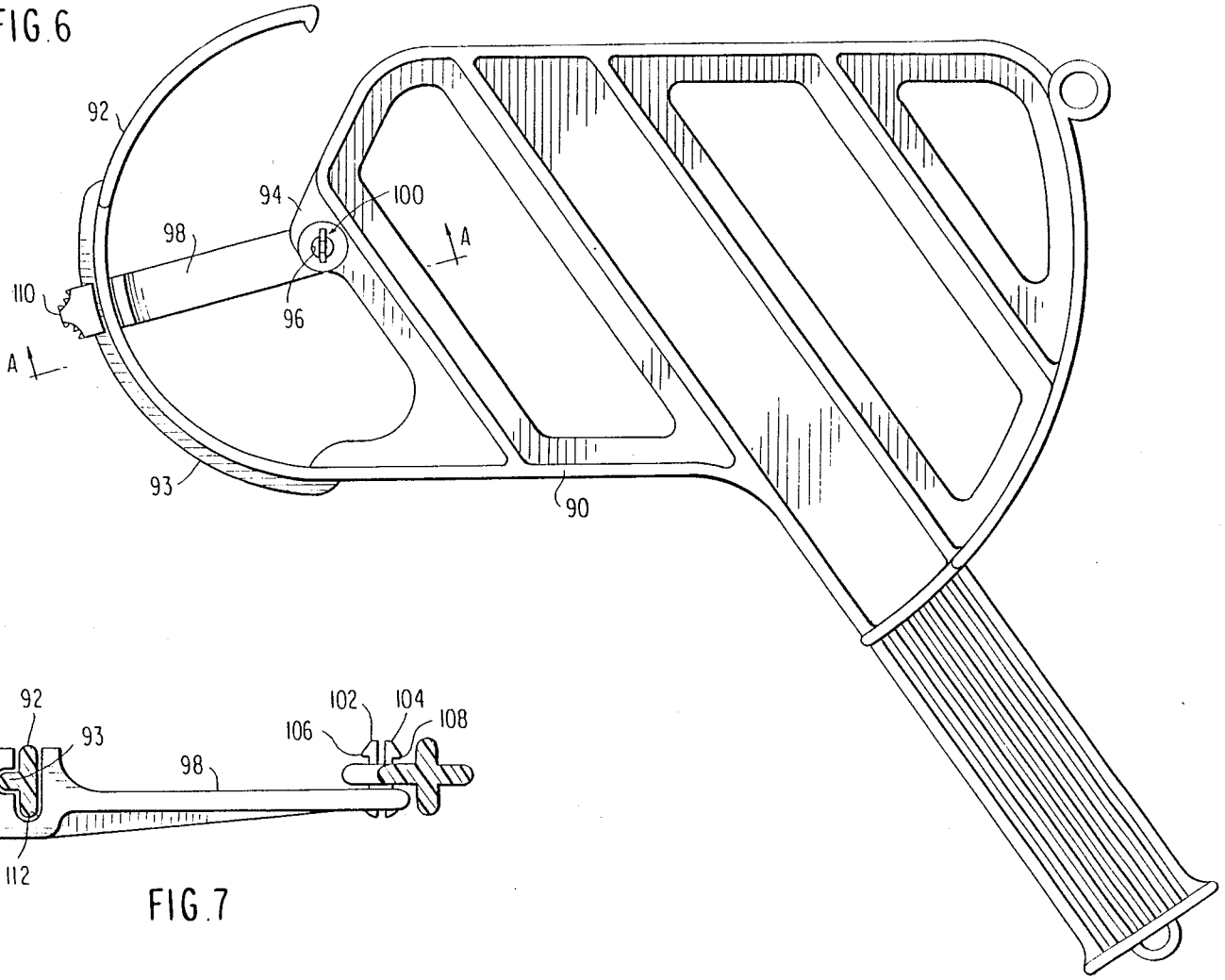
FIG. 6 is a plan view of a third embodiment of the disc launcher according to the present invention incorporating a modified means for adjusting the resiliency of the flexible arm.
Figure 7:
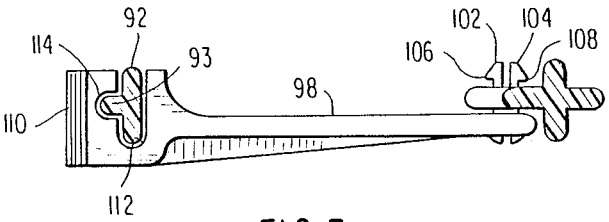
FIG. 7 is a sectional view taken along the line A—A in FIG. 6.

A further embodiment for varying the effective length and resiliency of the flexible arm having the projection thereon is shown in FIGS. 6 and 7. The head portion 90 and the flexible arm 92 are substantially identical to the construction shown in the embodiment of FIG. 1. However the flexible arm 92 is spaced a greater distance from the end of the head portion 90 and the end of the head portion 90 is formed with a boss 94 having an aperture 96 extending therethrough. An arm 98 is provided with a pivot pin arrangement 100 which is adapted to be detachably connected in the aperture 96. The pivot pin connection 100 is comprised of two spaced apart flexible fingers 102 and 104 which extend at right angles to the end of the arm 98. Oppositely extending projections 106 and 108 are formed on the fingers 102 and 104, respectively, so that upon squeezing the fingers 102 and 104 towards each other it is possible to insert or retract the fingers into and out of the aperture 96, respectively. Thus the arm 98 is pivotally mounted in a detachable manner on the boss 94 at the end of the head portion 90.

The opposite end of the arm 98 is provided with a projection which is adapted to slidably engage the flexible arm 92. The projection is provided with a finger grip portion 110 and a first groove 112 for receiving the lower portion of the flexible arm 92 therein. The projection is also formed with a second groove 114 for slidably receiving the reinforcing rib 93 which is on the outer surface of the flexible arm 92.

The flexible arm 92 is molded as an arc of a circle whose center, in the relaxed state of the arm 92, would be located to the left of the center aperture 96 as viewed in FIG. 6. Upon snapping the pivotal connection 100 on the end of the arm 98 into the aperture 96 and engaging the head portion of the opposite end of the arm 98 with the flexible arm 92 as shown in FIGS. 6 and 7, the center of curvature of the flexible arm 92 will be substantially coincident with the center of the aperture 96. Thus the outermost surface of the flexible arm 92 will be biased into sliding frictional engagement with the head portion of the arm 98 so that upon pivoting the arm 98 the effective length of the flexible arm 92 and therefore the resiliency thereof will be modified. The arm 98 will be held in adjusted position relative to the arm 92 by means of the frictional engagement therebetween. Complementary engaging teeth similar to those shown in FIG. 4 could be used if necessary. Since the launcher according to the present invention is symmetrical about the plane of the head it is possible to insert the pivotal connection 100 for the arm 98 into the aperture 96 in either direction to facilitate its manipulation by a left handed or right handed person.

As mentioned previously the entire launcher can be injection molded from plastics material and the launcher can be molded in different sizes to accommodate different size discs. The launchers are durable, light weight and inexpensive to produce since all of the parts are of molded plastic material. The only assembly operation necessary involves the simple attachment of the clamp 44 in FIG. 4 or the arm 98 in FIG. 6. The launcher can readily be used by either a left handed person or a right handed person in view of the symmetrical construction.

While the invention has been particularly shown and described with reference to preferred embodiments thereof it will be understood by those in the art that the foregoing and other changes in form and details may be made therein without departing from the spirit and scope of the invention.

What is claimed is:

1. A disc and disc launcher comprising a disc having a peripheral recess, and a disc launcher being of one piece molded plastic construction including a handle, a flat head portion extending outwardly from one end of the handle and disposed in a common plane with said handle, disc support means disposed along one peripheral end of said head portion on one side of the axis of said handle and projecting perpendicular to said plane an equal distance on opposite sides of said plane, a curved flexible resilient arm integrally formed with said head portion and having a free end extending outwardly from a flex point on the opposite peripheral end of said head portion on the other side of said axis in said plane with portions of said arm projecting on opposite sides of said plane for gripping the disc between said flexible resilient arm and said disc support means on either side of said head portion and projection means on the free end of said arm adapted to cooperate with said recess on said disc for engaging said disc and imparting a spinning action to said disc as the disc leaves the launcher upon flexing of the arm about said flex point under the action of centrifugal force imparted thereto.

2. A disc launcher as set forth in claim 1 further comprising adjusting means detachably mounted on said head portion and slidably engaging said arm for sliding movement along the length of said arm to effectively vary the location of the flex point about which the arm flexes.

3. A disc launcher as set forth in claim 2 further comprising complementary teeth means on said adjusting means and said head portion for selectively locking the slidable adjusting means in an adjusted position.

4. A disc launcher as set forth in claim 3 wherein said adjusting means is comprised of an arm having pivot means on one end thereof detachably connected to said head and engaging means on the opposite end thereof disposed in sliding frictional engagement with said flexible resilient arm.

5. A disc launcher as set forth in claim 2 further comprising a disc having engaging means thereon complementary to the engaging means on said arm.

* * * * *